US011072163B2

(12) United States Patent
Muraoka

(10) Patent No.: US 11,072,163 B2
(45) Date of Patent: Jul. 27, 2021

(54) PRINTING BLANKET, METHOD FOR MANUFACTURING THE SAME, AND PRINTING METHOD USING THE SAME

(71) Applicant: SHUHOU CO., LTD., Fukui (JP)

(72) Inventor: Kouji Muraoka, Fukui (JP)

(73) Assignee: SHUHOU CO., LTD, Fukui (JP)

( * ) Notice: Subject to any disclaimer, the term of this patent is extended or adjusted under 35 U.S.C. 154(b) by 191 days.

(21) Appl. No.: 16/097,427

(22) PCT Filed: Apr. 28, 2016

(86) PCT No.: PCT/JP2016/063458
§ 371 (c)(1),
(2) Date: Oct. 29, 2018

(87) PCT Pub. No.: WO2017/187626
PCT Pub. Date: Nov. 2, 2017

(65) Prior Publication Data

US 2019/0134973 A1 May 9, 2019

(51) Int. Cl.
*B41M 1/40* (2006.01)
*B41F 17/34* (2006.01)
(Continued)

(52) U.S. Cl.
CPC ..... *B41F 17/34* (2013.01); *B41F 17/001* (2013.01); *B41F 17/006* (2013.01); *B41F 17/28* (2013.01); *B41M 1/40* (2013.01); *B41N 10/04* (2013.01)

(58) Field of Classification Search
CPC ..... B41F 17/001; B41F 17/006; B41F 17/34; B41N 10/00; B41N 10/02; B41N 10/04; B41M 1/40
(Continued)

(56) References Cited

U.S. PATENT DOCUMENTS 2,748,696 A * 6/1956 Murray ..... C04B 41/50 101/41
3,701,317 A * 10/1972 Miyamoto ..... H05K 3/1275 101/170
(Continued)

FOREIGN PATENT DOCUMENTS

CN 1461979 A 12/2003
CN 101010203 A 8/2007
(Continued)

OTHER PUBLICATIONS

Korean Decision of Rejection with an English translation dated Sep. 22, 2020 for Application No. KR 10-2018-7028981.
(Continued)

*Primary Examiner* — Leslie J Evanisko
(74) *Attorney, Agent, or Firm* — Ladas & Parry LLP

(57) ABSTRACT

There are provided a printing blanket which maintains the accuracy of printing of an image, and also prevents a failure of transfer of an ink from an original printing plate to the printing blanket, a method for manufacturing the printing blanket, and a printing method using the printing blanket. The printing blanket according to the present invention includes an elastic body which deforms in conformity to the shape of a to-be-printed surface. The elastic body includes a printing surface to be pressed against the to-be-printed surface. In the printing surface, an entire region is provided with a plurality of irregularities are formed over the entire surface of the printing surface, and an elevation difference from a highest part of the irregularities to a lowest part thereof falls within the range of 2 to 20 μm.

10 Claims, 6 Drawing Sheets

(51) Int. Cl.
*B41N 10/04* (2006.01)
*B41F 17/28* (2006.01)
*B41F 17/00* (2006.01)

(58) Field of Classification Search
USPC ..... 101/492, 493, 153
See application file for complete search history.

(56) References Cited

U.S. PATENT DOCUMENTS

| | | | | |
|---|---|---|---|---|
| 5,832,824 | A * | 11/1998 | Okubo | B41N 6/00 101/217 |
| 2004/0019266 | A1 * | 1/2004 | Marciante | A61B 17/22004 600/407 |
| 2007/0214977 | A1 | 9/2007 | Okamoto | |
| 2008/0011177 | A1 | 1/2008 | Muraoka | |
| 2011/0169344 | A1 | 7/2011 | Suekane et al. | |
| 2011/0315035 | A1 | 12/2011 | Muraoka | |
| 2012/0318154 | A1 | 12/2012 | Muraoka | |

FOREIGN PATENT DOCUMENTS

| | | | |
|---|---|---|---|
| CN | 101014466 | A | 8/2007 |
| CN | 101041306 | A | 9/2007 |
| CN | 102781679 | A | 11/2012 |
| CN | 104098784 | A | 10/2014 |
| EP | 1 775 140 | A1 | 4/2007 |
| EP | 2 543 519 | A1 | 1/2013 |
| JP | 60-25756 | A | 2/1985 |
| JP | H0647895 | A | 2/1994 |
| JP | 8-183165 | A | 7/1996 |
| JP | 10-86549 | A | 4/1998 |
| JP | 2005-190969 | A | 7/2005 |
| JP | 2006-69175 | A | 3/2006 |
| JP | 2007256334 | A | 10/2007 |
| JP | 2011-736 | A | 1/2011 |
| JP | 2011-224894 | A | 11/2011 |
| JP | 2013-529564 | A | 7/2013 |
| JP | 2015-89670 | A | 5/2015 |
| JP | 2015217652 | A | 12/2015 |
| KR | 10-2007-041157 | A | 4/2007 |
| KR | 1020110054052 | A | 5/2011 |
| KR | 10-2012-0130191 | A | 11/2012 |
| WO | 2012/000982 | A1 | 1/2012 |

OTHER PUBLICATIONS

Supplementary European Search Report dated Oct. 17, 2019 for Application No. EP 16900496.7.
Chinese Office Action with an English translation dated Nov. 4, 2019 for Application No. CN 201680085007.5.
Espacenet English abstract of CN 101014466 A.
Espacenet English abstract of CN 101041306 A.
Espacenet English abstract of JP 2005-190969A.
Japanese Office Action with an English translation dated Jan. 7, 2020 for Application No. JP 2018-514076.
Korean Office Action with an English translation dated Jan. 16, 2020 for Application No. KR 10-2018-7028981.
Chinese Office Action with an English translation dated Jun. 24, 2020 for Application No. CN 201680085007.5.
Korean Office Action with an English translation dated Jul. 21, 2020 for Applicatim No. KR 10-2018-7028981.
Japanese Office Action with an English translation dated Jun. 18, 2019 for Application No. JP 2018-514076.
International Search Report (ISR) and Written Opinion (WO) dated Jul. 19, 2016 for Application No. PCT/JP2016/063458.
Japanese Patent Office English abstract and translation of JP 2006-69175 A.
Japanese Patent Office English abstract and translation of JP 2011-224894 A.
Japanese Patent Office English abstract and translation of JP 60-25756 A.
Japanese Patent Office English abstract and translation of JP 2015-89670 A.
Japanese Patent Office English abstract and translation of JP 10-86549 A.
Japanese Patent Office English abstract and translation of JP 2011-736 A.
Korean office action with an English translation dated May 17, 2021 for Application No. KR 10-2020-7030507.

* cited by examiner

PRINTING BLANKET, METHOD FOR MANUFACTURING THE SAME, AND PRINTING METHOD USING THE SAME

RELATED APPLICATION

This application is an application under 35 U.S.C. 371 of International Application No. PCT/JP2016/063458 filed on Apr. 28, 2016, the entire contents of which are incorporated herein by reference.

TECHNICAL FIELD

The present invention relates to a printing blanket for use in blanket printing in which ink transferred from an original printing plate is transferred onto a to-be-printed surface.

BACKGROUND ART

In conventional blanket printing, a printing surface of a printing blanket is pressed against an original printing plate, whereby ink arranged on the original printing plate in accordance with a printing pattern is transferred to the printing blanket. Subsequently, the printing surface of the printing blanket on which the ink has been transferred is pressed against a to-be-printed surface to transfer the transferred ink onto the to-be-printed surface, whereby the printing pattern is printed on the to-be-printed surface.

In the conventional blanket printing, the printing blanket is an elastic body having elasticity (flexibility), such as silicon rubber with silicon oil blended therein, and has a substantially hemispherical shape, a bombshell shape, or has a cross section having a substantially semi-columnar bombshell shape. After the printing surface of the elastic body is pressed against the original printing plate having a flat shape and the ink is transferred from the original printing plate to the printing surface, the printing surface is pressed against the to-be-printed surface having a curved shape or irregularities, whereby the ink is transferred from the printing surface to the to-be-printed surface.

For example, Patent Literature 1 discloses the following technique: "ink is placed on small original printing plates 30*a*, 30*b*, 30*c* and 30*d* (hereinafter referred to as "small original printing plates 30" as the case may be) respectively associated with small to-be-printed surfaces 1, along small development patterns 3 in the small to-be-printed surfaces 1 associated therewith (S4 indicated in FIG. 1)"; "small printing blankets 40*a*, 40*b*, 40*c* and 40*d* (hereinafter referred to as "small printing blankets 40" as the case may be) respectively associated with the small to-be-printed surfaces 1 are then pressed against the associated small original printing plates 30, whereby the ink is transferred onto the associated small printing blankets 40 (S5 indicated in FIG. 1)"; and "furthermore, the small printing blankets 40 are pressed against the associated small to-be-printed surfaces 1 to print small patterns 2 thereon (S6 indicated in FIG. 1)".

CITATION LIST

Patent Literature

Patent Literature 1: Japanese Unexamined Patent Application Publication No. 2011-736

SUMMARY OF INVENTION

Technical Problem

In the printing disclosed in Patent Literature 1, in order that printing be carried out finely with a high accuracy, the ink to be placed on the original printing plate is required to be arranged finely with a high accuracy. Furthermore, when the printing blanket is pressed against the original printing plate, the ink put on the original printing plate is required to be prevented from being crushed and spreading. In order to satisfy those requirements, the ink to be placed on the original printing plate needs to be made to have a high viscosity. However, if the viscosity of the ink is high, the ink cannot be easily made to adhere to the printing surface of the printing blanket, and the ink cannot be reliably transferred from the original printing plate to the printing blanket.

On the other hand, in order to reliably transfer the ink on the original printing plate to the printing surface of the printing blanket, if the viscosity of the ink on the original printing plate is reduced, the ink is crushed when the printing blanket is pressed against the original printing plate, and as a result, an image is printed with a lower accuracy.

The present invention has been made to solve the above problems, and an object of the invention is to provide a printing blanket which enables an image to be printed with an accuracy, and can prevent a failure in transfer of ink from an original printing plate to the printing blanket; a method for manufacturing the printing blanket; and a printing method using the printing blanket.

Solution to Problem

A printing blanket of an embodiment of the present invention includes an elastic body which deforms in accordance with the shape of a to-be-printed surface. The elastic body includes a printing surface to be pressed against the to-be-printed surface. Over the entire area of the printing surface, a plurality of irregularities are formed, and the difference of elevation between a highest part of the irregularities and a lowest part thereof falls within the range of 2 to 20 μm.

ADVANTAGEOUS EFFECTS OF INVENTION

According to the present invention, the printing surface of the printing blanket is pressed against the original printing plate while the viscosity of the ink on the original printing plate is kept high, and the ink can thus be transferred to the printing surface. It is therefore possible to prevent the ink from being crushed, and transfer the ink onto the printing surface while maintaining the resolution of a printed image. By virtue of this feature, a fine image can be printed onto a to-be-printed surface having a curved shape or irregularities.

DESCRIPTION OF EMBODIMENTS

Embodiment 1

Figure 1:
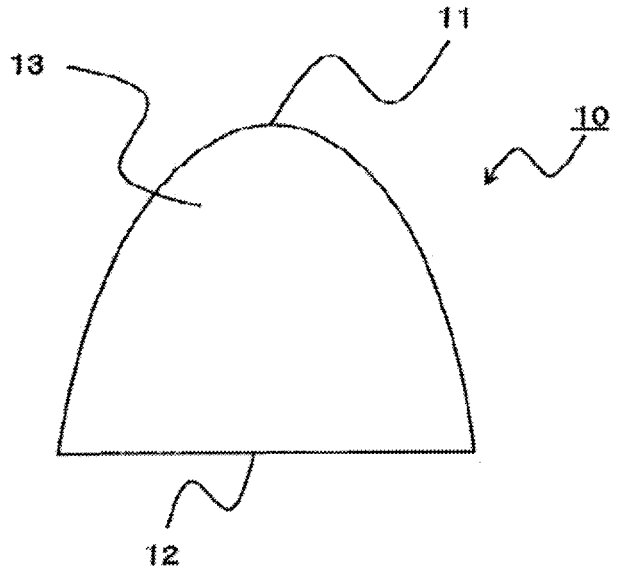
FIG. 1 is a side view illustrating an example of a printing blanket according to embodiment 1 of the present invention.

A printing blanket according to the present invention will be described below with reference to the drawings. It should be noted that the present invention is not to be limited to embodiment 1 to be described below. Furthermore, identical portions in the drawings are denoted by the same reference signs, and some of descriptions thereof will be omitted. The drawings are schematically made, and the present invention is not limited to the shapes illustrated in the drawings (especially, a sheet therein is exaggerated in thickness). In the following description, the term "elastic body" or "elastic" is not limited to an element which is provided such that a load applied to the element and the amount of deformation thereof which is caused by the applied load have a linear relationship, and covers an element which is provided such that the above load and the amount of deformation of the element have a nonlinear relationship, and such that the element is restored to its original shape immediately after the element is released from the applied load or after an elapse of a predetermined time period from the time when the element is released from the applied load.

Printing Blanket 10

FIG. 1 is a side view illustrating an example of a printing blanket 10 according to embodiment 1 of the present invention. The printing blanket 10 as illustrated in FIG. 1 is an elastic body having a substantially hemispherical shape. As a flat part of the body having the substantially hemispherical shape is located on a lower side, and is defined as a bottom surface, the distance from the center of the bottom surface to an apex 11 is greater than that of a normal hemisphere having a bottom surface having the same size as the above bottom surface. That is, the printing blanket has a shape similar to that of a bombshell. The shape of the printing blanket is not limited to this. For example, the shape may be appropriately changed in accordance with the specifications of a to-be-printed surface 18, e.g., a spherical shape, a curved shape obtained by rotating a parabola around its symmetry axis, the shape of a cut part of ellipsoid, or a shape obtained by continuously extending a bombshell shape or a semicircular shape in a straight line. In embodiment 1, of the surface of the printing blanket 10, a predetermined area on which the apex 11 is centered is a printing surface 13 to which ink 17 is transferred from an original printing plate, and which transfers the ink 17 onto a to-be-printed surface 18.

Figure 2:
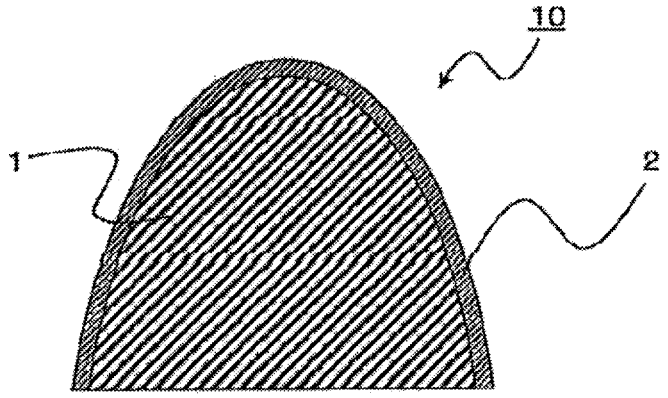
FIG. 2 is a cross-sectional view of the printing blanket as illustrated in FIG. 1.

FIG. 2 is a cross-sectional view of the printing blanket 10 as illustrated in FIG. 1. It illustrates a cross section which is taken through the apex 11 of the printing blanket 10 and is perpendicular to the bottom surface. As illustrated in FIG. 2, the printing blanket 10 includes a base 1 and a sheet 2 which is attached to the base 1 along a curved surface thereof. In embodiment 1, the elastic body forming the printing blanket 10 is made up of the base 1 and the sheet 2 attached along the curved surface of the base 1. The sheet 2 corresponds to a cover layer of the present invention. The elastic body is not limited to a two-layer structure including the base 1 and the sheet 2 as illustrated in FIG. 2, and may be made up of a larger number of layers. Moreover, the elastic body may be provided as a single-layer elastic body not made up of a plurality of layers.

Base 1

Figure 3A:
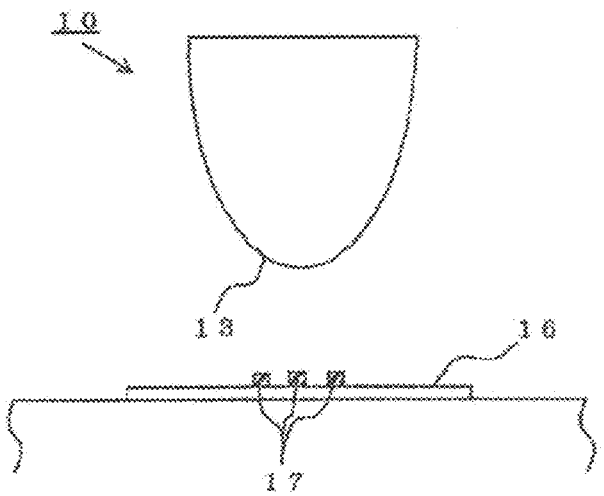
FIG. 3A-C illustrates printing performed using the printing blanket according to embodiment 1 of the present invention.
Figure 3B:
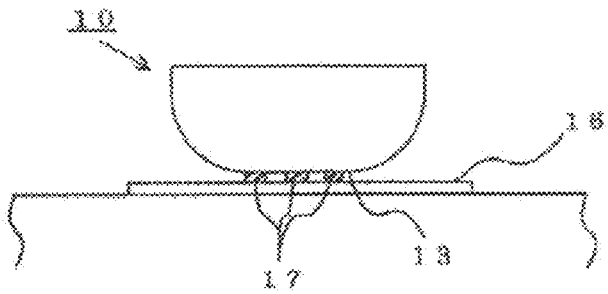
Figure 3C:
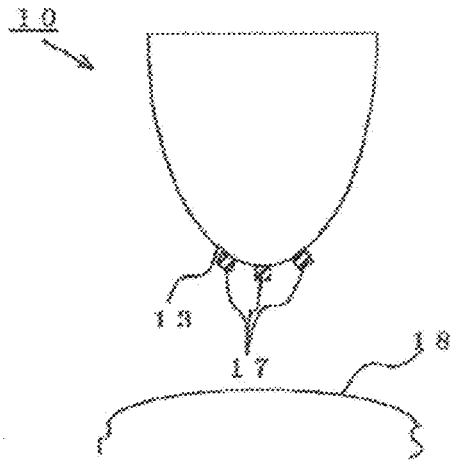
Figure 4A:
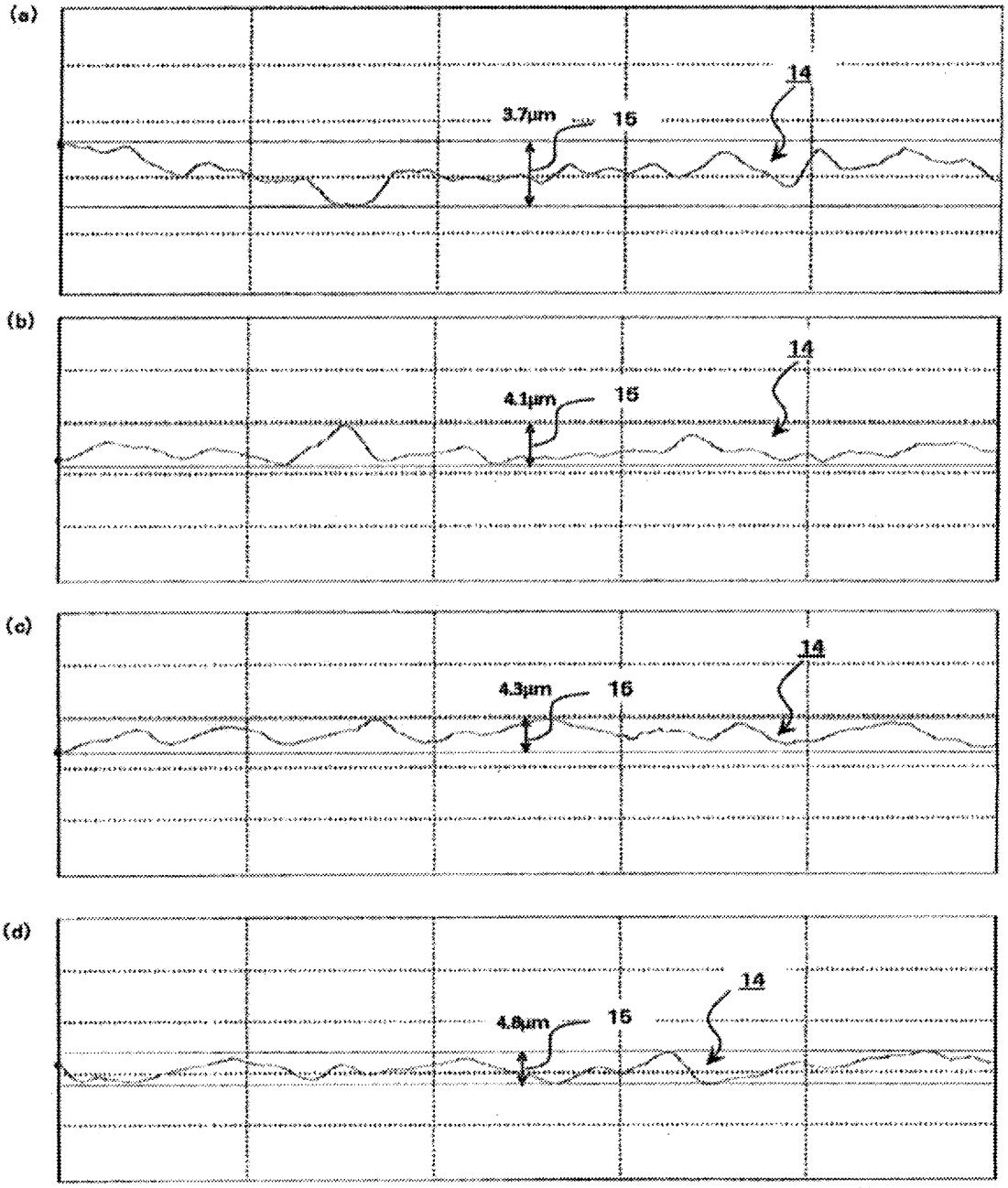
FIG. 4A is a diagram obtained by measuring irregularities of parts of printing surfaces of printing blankets according to embodiment 1 of the present invention.
Figure 4B:
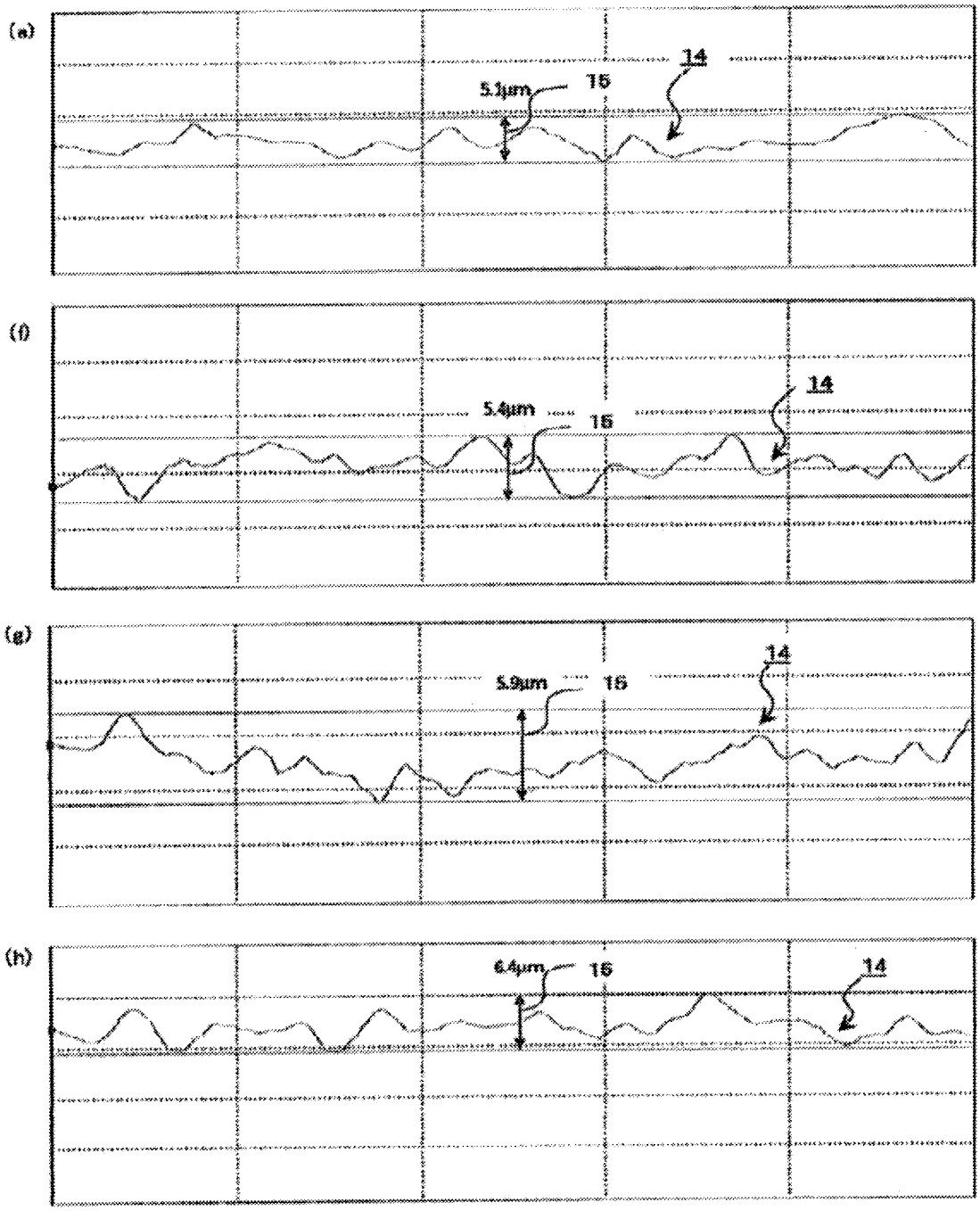
FIG. 4B is a diagram obtained by measuring irregularities of parts of printing surfaces of printing blankets according to embodiment 1 of the present invention.
Figure 4C:
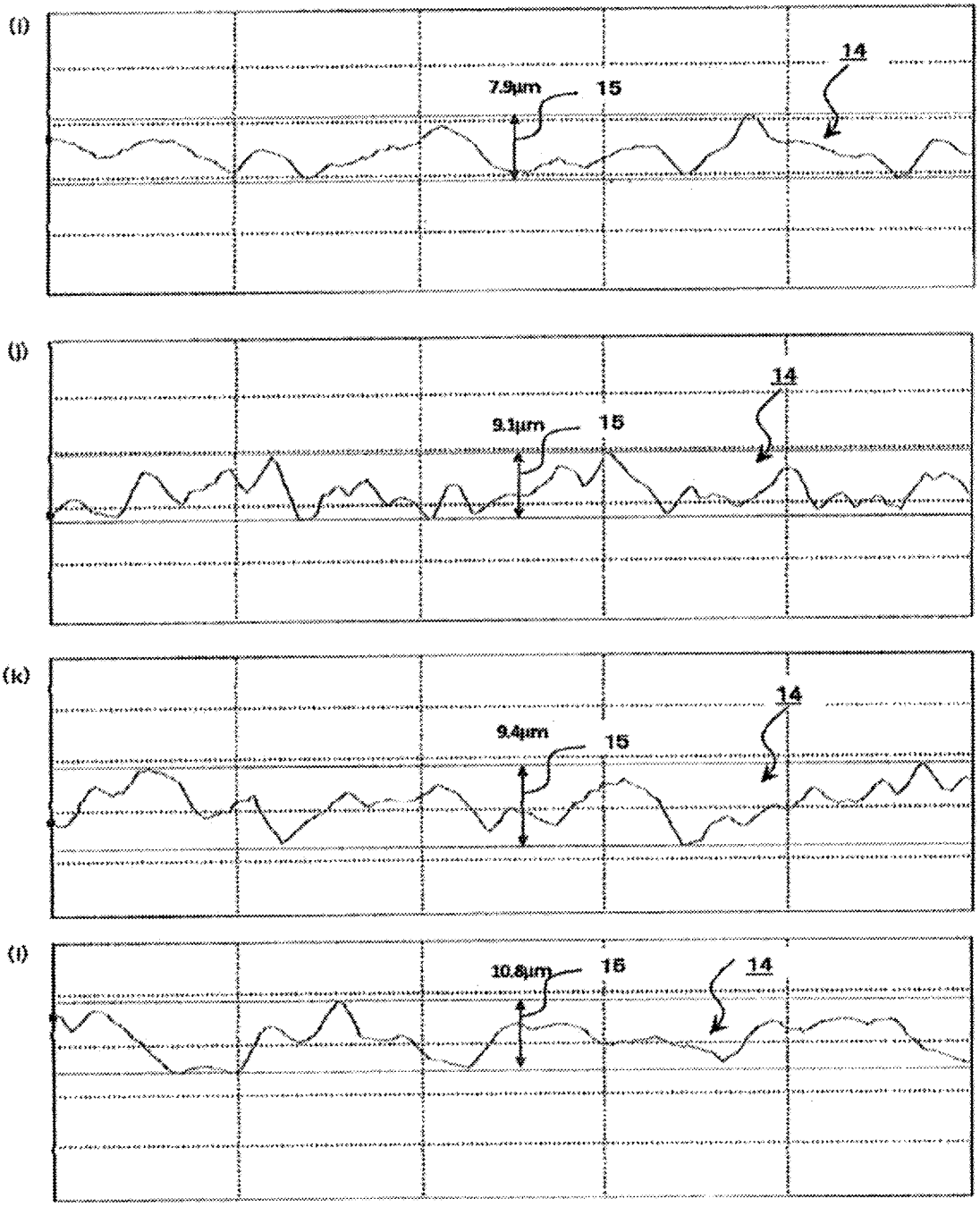
FIG. 4C is a diagram obtained by measuring it of parts of printing surfaces of printing blankets according to embodiment 1 of the present invention.
Figure 4D:
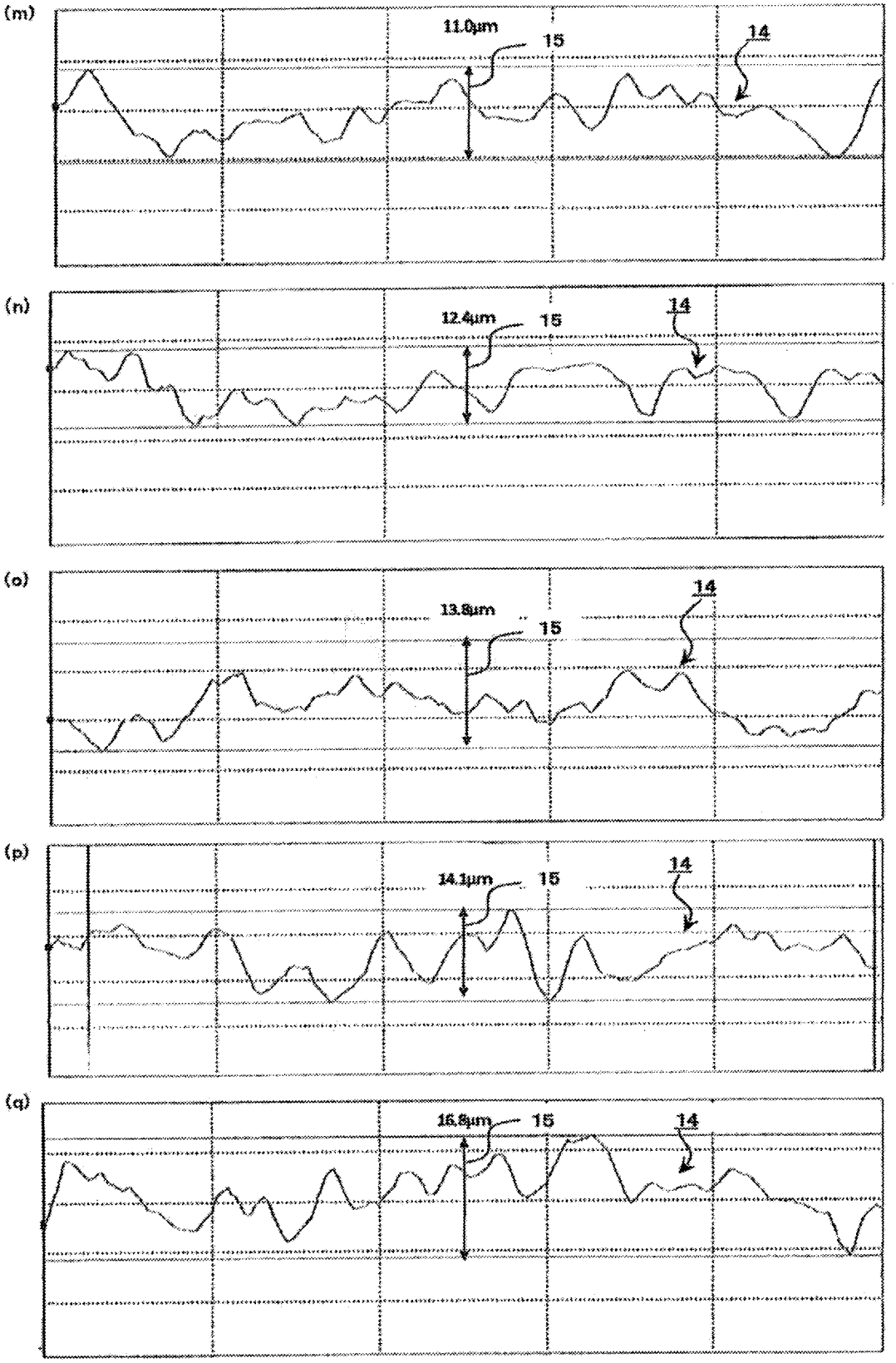
FIG. 4D is a diagram obtained by measuring irregularities of parts of printing surfaces of printing blankets according to embodiment 1 of the present invention.

The base 1 is formed, for example, by molding silicon rubber. In the base 1, silicon oil is blended therein in order that the base 1 be given elasticity (flexibility) and be easily deformed. In embodiment 1, the base 1 is formed in a bombshell shape in a similar manner to formation of the printing blanket 10, but its shape may be appropriately changed in accordance with, for example, the specifications of the to-be-printed surface 18. The material (substance) of the base 1 is not limited to the above material as long as it causes the base 1 to satisfy the following requirements: when pressed against an original printing plate 16 which is provided illustrated in FIG. 3, the base 1 can be deformed and cause the ink 17 corresponding to a printing pattern applied to the original printing plate 16 to be transferred to the sheet 2; and when pressed against the to-be-printed surface 18 which is provided as illustrated in FIG. 3, the base 1 can cause the transferred ink 17 to be transferred onto the to-be-printed surface 18.

Sheet 2

The sheet 2 is formed of silicon rubber shaped in the form of a sheet having a predetermined thickness (e.g., 0.5 mm). In embodiment 1, for example, it is formed of silicon rubber which has a higher hardness and lower content of silicon oil than those of the silicon rubber forming the base 1. It should be noted that the material of the sheet 2 is not limited to the above material so long as it can cause the sheet 2 to satisfy the following requirements: when pressed against the original printing plate 16, the sheet 2 can cause the ink 17 corresponding to the printing pattern applied to the original printing plate 16 to be transferred to the sheet 2, and when pressed against the to-be-printed surface 18, the sheet 2 can transfer the transferred ink 17 onto the to-be-printed surface 18. In addition, the material can be applied if it has a sufficient elasticity in order that the sheet 2 be attached to the base 1 along the surface thereof in a process of attaching the sheet 2 to the base 1, which will be described later.

The sheet 2 is molded, for example, using a mold, and the surface of the sheet 2 may be formed to have irregularities 14 by molding. To be more specific, the surface of the sheet 2 may be in advance formed to have irregularities 14 such that an elevation difference 15 from the highest part of the irregularities 14 to the lowest part thereof falls within the range of 2 μm to 20. The sheet 2 is attached to at least a part of the surface of the base 1, and serves as the printing surface 13 of the printing blanket 10. The sheet 2 is attached to the base 1 by, for example, an adhesive.

Printing Using Printing Blanket 10

FIG. 3 illustrates printing performed by the printing blanket 10 according to embodiment 1 of the present invention. With respect to embodiment 1, printing performed by the printing blanket 10 formed in a bombshell shape will be described as an example.

As illustrated in FIG. 3(*a*), in embodiment 1, the ink 17 is put on the original printing plate 16. The ink 17 is put such that a group of a plurality of ink components thereof are arranged to form a predetermined printed image. The ink 17 is put on the original printing plate 16, for example, by intaglio printing, relief printing, or inkjet printing.

As illustrated in FIG. 3(*b*), the printing blanket 10 is pressed against the original printing plate 16 from the apex 11 and is thus deformed, and the predetermined area on which the apex 11 is centered is pressed against the surface of the original printing plate 16. The predetermined area will be referred to as the printing surface 13. The ink 17 on the original printing plate 16 adheres to the printing surface 13 of the printing blanket 10, and is therefore transferred to the printing surface 13. Since the base 1 is formed of silicon rubber containing a large amount of silicon oil, it is easily deformed. On the other hand, although the sheet 2 attached to the surface of the base 1 is formed of, for example, silicon rubber having higher hardness than that of the base 1, the sheet 2 is deformed in conformity to the deformation of the base 1 since the sheet 2 is a thin sheet. It should be noted that the material of the sheet 2 is not limited to silicon rubber having higher hardness than the base 1, and the hardness and the material of the sheet 2 can be selected as appropriate as long as they cause the sheet 2 to follow the deformation of the base 1.

Before the printing blanket 10 is pressed against the original printing plate 16, the printing surface 13 may be coated with a solution, and thus made in a wet state. By performing this process, the ink 17 can be easily transferred onto the printing surface 13.

As illustrated in FIG. 3(*c*), after the ink 17 is transferred onto the printing surface 13, the printing surface 13 is pressed against the to-be-printed surface 18. As a result, the ink 17 transferred to the printing surface 13 is transferred therefrom onto the to-be-printed surface 18, whereby a printed image is transferred thereto. Since the printing blanket 10 is formed easily deformable, it satisfactorily conforms to the shape of the to-be-printed surface having the curved surface. Furthermore, the sheet 2 is formed of silicon rubber having higher hardness than the base 1, and has low content of silicon oil, whereby when the printing blanket 10 is deformed, the silicon oil blended in the base 1 is substantially shut by the sheet 2 surrounding the base 1. Moreover, the amount of silicon oil blended in the sheet 2 is small, and thus the silicon oil does not easily ooze out of the printing surface 13, which is located at the position of the surface of the sheet 2. Accordingly, a moderate amount of silicon oil adheres to the printing surface 13. Thus, when the printing surface 13 is pressed against the to-be-printed surface 18, the ink 17 hardly remains on the printing surface 13, and is easily transferred onto the to-be-printed surface 18.

Printing Surface 13

The sheet 2 attached to the base 1 has the irregularities 14 at least on the opposite side of the side at which the base 1 is located. That is, in the printing blanket 10, the printing surface 13 has the irregularities 14. To be more specific, the printing surface 13 is formed to have the irregularities 14 such that the elevation difference 15 from the highest part of the irregularities 14 to the lowest part thereof falls within the range of 2 to 20 μm. In other words, the printing surface 13 has a three-dimensional surface roughness Sz (i.e., a maximum height) of 2 to 20 μm. Also, the printing surface 13 has a three-dimensional surface roughness Sa (i.e., an arithmetic mean) of 0.2 to 2.0 μm. The irregularities 14 of the printing surface 13 are formed over the entire area of the printing surface 13.

FIGS. 4A to 4D illustrate diagrams obtained by measuring irregularities 14 of parts of printing surfaces 13 of printing blankets 10 according to embodiment 1 of the present invention. In diagrams (a) to (q) illustrated in FIGS. 4A to 4D, the irregularities 14 of the printing surfaces 13 were measured with respect to the printing blankets 10 which have various elevation differences 15 each of which is an elevation difference from the highest part to lowest part of the corresponding irregularities 14. Specifically, the diagrams (a) to (q) in FIGS. 4A to 4D illustrate the irregularities 14 of the printing surfaces 13 of different printing blankets 10. With respect to an arbitrary part of each of the printing surfaces 13, a straight line having a predetermined reference length was determined, and a surface profile thereof was measured along the straight line. As a result, the irregularities 14 of each printing surface 13 was measured as illustrated in FIGS. 4A to 4D. As illustrated in FIGS. 4A to 4D, the irregularities 14 formed on each printing surface 13 have an irregular pattern. In embodiment 1, a straight line having a reference length of 610 μm was set, and the irregularities 14 were measured along the straight line. According to this measurement, the elevation difference 15 from the highest part to the lowest part of the irregularities 14 was 3.7 μm at minimum and 16.8 μm at maximum.

In the printing blankets having the above configurations, even in the case where the viscosity of the ink 17 on the original printing plate 16 is high, the ink 17 adheres to the irregularities 14 formed on the printing surface 13, and is more easily transferred from the original printing plate 16 to the printing surface 13.

In the conventional printing blanket 10, a printing surface 13 is made to be a substantially mirror surface. Specifically, it is made to have irregularities 14 such that the elevation difference 15 from the highest part of the irregularities 14 to the lowest part thereof is set to 1 μm or less. When printing is performed using the conventional printing blanket 10, the viscosity of ink 17 is 10 to 100 P (poise). By setting the viscosity of the ink 17 to such a low value, the ink 17 is reliably transferred from an original printing plate 16 to the printing surface 13 of the printing blanket 10.

The ink 17 placed on the original printing plate 16 is located such that a larger number of minute dots are grouped together to form a predetermined image as the original printing plate 16 is seen perpendicularly from above. The ink 17 placed on the original printing plate 16 has a predetermined height. Thus, when the printing surface 13 of the printing blanket 10 is pressed against the original printing plate 16, the ink 17 on the original printing plate 16 is pressed and deformed by the printing surface 13. If the ink 17 has low viscosity as in the conventional printing blanket, the ink 17 is crushed. When the ink 17 located as a larger number of dots on the original printing plate 16 is transferred to the printing surface 13 of the printing blanket 10, it spreads over a wider area than when the ink 17 was present on the original printing plate 16. Consequently, the ink 17 forms an image having a low resolution.

In contrast, in the printing blanket 10 according to embodiment 1, the printing surface 13 is formed to have irregularities 14 such that the elevation difference 15 from the highest part of the irregularities 14 to the lowest part thereof falls within the range of 2 to 20 μm. Therefore, in printing to be performed using the printing blanket 10 according to embodiment 1, the viscosity of the ink 17 can be set to a high value. Specifically, the viscosity of the ink 17 can be set to a value of 100 to 1000 P. Therefore, even when the printing surface 13 of the printing blanket 10 is pressed against the original printing plate 16, the ink 17 located as a larger number of dots on the original printing plate 16 hardly deforms and hardly spreads. As a result, when the ink 17 is transferred to the printing surface 13, reduction of the resolution of the image can be restricted, as a result of which an image can be printed onto the to-be-printed surface 18 to have a higher resolution.

Using the printing blankets 10 having the irregularities 14 as illustrated in the diagrams (a) to (q) in FIGS. 4A to 4D, tests were performed in each of which actually, the ink 17 was transferred from the original printing plate 16 to the printing blanket 10, and the ink 17 was printed onto the to-be-printed surface 18. The results of all the tests indicate that the ink 17 could be transferred from the original printing plate 16 to the printing blanket 10, and printing was performed satisfactorily. According to these test results, it is appropriate that the printing surface 13 of the printing blanket 10 is made to have irregularities 14 such that the elevation difference 15 from the highest part of the irregularities 14 to the lowest part thereof falls within the range of 5 μm to 15 μm. That is, it is appropriate that the three-dimensional surface roughness Sz is set to a value of 5 μm to 15 μm. Also, the printing surface 13 has a three-dimensional surface roughness Sa (i.e., an arithmetic mean) of 0.5 μm to 1.2 μm. In each of the tests, printing was performed with ink 17 having a viscosity which falls within the range of 100 to 1000 P.

Method For Manufacturing Printing Blanket 10

Process of Molding Base 1

The base 1 is formed, for example, by molding silicon rubber with a mold. In embodiment 1, since the printing blanket 10 has a two-layer structure, the base 1 is molded without particularly adjusting the surface roughness thereof. In the case where the elastic body forming the printing blanket 10 is formed of a single molded product, the surface of part of the mold which is used for molding the printing surface 13 of the printing blanket 10 is processed in advance to have a predetermined surface roughness. Thus, the elastic body is molded such that irregularities 14 of the surface of the mold are transferred thereto. This process corresponds to a base molding process of the present invention.

Process of Molding Sheet 2

The sheet 2 is also formed, for example, by molding silicon rubber with a mold. In embodiment 1, the sheet 2 includes the surface of the elastic body constituting the printing blanket 10. In other words, the printing surface 13 is located in the sheet 2. Therefore, the surface of part of the mold which is used for molding at least one of the surfaces of the sheet 2 is processed in advance to have a predetermined surface roughness. Thus, the sheet 2 is molded such that irregularities of the surface of the mold are transferred thereto. The surface of the molded sheet 2 has predetermined irregularities 14. In embodiment 1, the surface of the molded sheet 2 is molded such that the elevation difference 15 from the highest part of the irregularities 14 to the lowest part thereof falls within the range of 2 to 20 μm. Alternatively, the sheet 2 may be molded such that the elevation difference 15 from the highest part of the irregularities 14 to the lowest part thereof is 20 μm or more. This process corresponds to a cover-layer molding process of the present invention.

Process Of Finishing Sheet 2

In the process of molding the sheet 2, in the case where the surface of the molded sheet 2 is molded such that the elevation difference 15 from the highest part to the lowest part of the irregularities 14 falls within the range of 2 to 20 μm, the process to be carried out may directly proceed to a process of attaching the sheet 2, which will be described later. However, when the elevation difference 15 from the highest part to the lowest part of the irregularities 14 falls within the range of 2 to 20 μm, if the elevation difference 15 is further required to be set to a predetermined value, the surface of the sheet 2 is abraded using an abrasive, such as a coated abrasive, in this process, to thereby cut away protrusions of the irregularities 14, i.e., tall parts thereof which have great heights. Alternatively, an abrasive sponge, such as a melamine sponge, may be applied. Furthermore, in the case where the surface of the sheet 2 is molded such that the elevation difference 15 from the highest part to the lowest part of the irregularities is 14 to 20 μm or more, the surface of the sheet 2 is abraded using, for example, a coated abrasive to cut away tall parts of the irregularities 14 which have great heights, such that the elevation difference 15 from the highest part to the lowest part of the irregularities 14 falls within the range of 2 to 20 μm. As a result, the elevation difference 15 from the highest part to the lowest part of the irregularities 14 can be set to fall within range of 2 to 20 μM.

Furthermore, in a process of molding the sheet 2, if the surface of the sheet 2 is molded to have a roughness equivalent to or close to that of a mirror surface, the surface of the sheet 2 may be roughened in this process by abrading the surface using an abrasive, such as a coated abrasive or an abrasive sponge. Thereby, the surface can be processed such that the elevation difference 15 from the highest part to the lowest part of the irregularities 14 falls within the range of 2 to 20 μm. Moreover, the printing surface 13 can be made to have a three-dimensional surface roughness Sz of 2 μm to 20 μm or a three-dimensional surface roughness Sa of 0.2 to 2.0 μm.

This process corresponds to a printing-surface finishing step of the present invention.

Process of Processing Surface of Sheet 2

In order to curt away the tall parts of the irregularities 14 of the surface of the sheet 2, a process of melting or corroding the surface of the sheet 2 may be carried out prior to the above finishing step, to thereby enable the tall parts of the irregularities 14 to be easily cut away. In embodiment 1, for example, a solution such as ethanol is applied onto the surface of the sheet 2. Alternatively, a solution for melting the material of the sheet 2 to enable the tall parts of the irregularities 14 of the surface to be easily cut away may be selected in accordance with the material of the sheet 2. Instead of proceeding to the above process of finishing the sheet 2 after applying the solution to the surface of the sheet 2, the process of applying the solution to the surface of the sheet 2 and the process of finishing the sheet 2 may be performed at the same time. For example, the surface of the sheet 2 may be abraded with a melamine sponge soaked with the solution. This process corresponds to a surface-processing process of the present invention.

Furthermore, instead of applying the solution to the surface of the sheet 2, for example, ozone gas may be made to blow onto the surface of the sheet 2 to degrade or corrode the surface. The gas to be made to blow onto the surface may be changed as appropriate in accordance with the material of which the printing surface 13 is formed.

Process Of Attaching Sheet 2

Next, the sheet 2 is attached to the base 1. The sheet 2 and the base 1 are adhered to each other by, for example, an adhesive. The adhesion is carried out such that air bubbles do not enter space between the sheet 2 and the base 1. After the adhesive cures, the sheet 2 and the base 1 can be deformed like a single elastic body. The process of processing the surface of the sheet 2 and the process of finishing the sheet 2 may be carried out after the process of attaching the sheet 2.

In the above explanation, the method for manufacturing the printing blanket 10 having the two-layer structure is described. In the case where the printing blanket 10 is formed of a single elastic body alone, a part of the surface of the base 1 that corresponds to the printing surface 13 is made, with a mold, to have irregularities 14. Furthermore, by performing on the part of the surface of the base 1 that corresponds to the printing surface 13, the above process of finishing the sheet 2 and the above process of processing the surface of the sheet 2, the elevation difference 15 from the highest part to the lowest part of the irregularities 14 of the printing surface 13 is set to fall within the range of 2 μm and 20 μm. In other words, the printing surface 13 is set to have a three-dimensional surface roughness Sz (i.e., a maximum height) of 2 to 20 μm, or the printing surface 13 is set to have a three-dimensional surface roughness Sa (i.e., an arithmetic mean) of 0.2 to 2.0 μm.

It is preferable that the elevation difference 15 from the highest part to the lowest part of the irregularities 14 of the printing surface 13 be set to fall within the range of 5 to 15 μm. Also, in terms of surface roughness, it is preferable that the printing surface 13 be set to have a three-dimensional surface roughness Sz of 5 to 15 μm or a three-dimensional surface roughness Sa (i.e., an arithmetic mean) of 0.5 to 1.2 μm.

Advantages Of Embodiment (1) The printing blanket 10 according to embodiment 1 includes the elastic body which deforms to conform to the shape of the to-be-printed surface 18; the elastic body includes the printing surface 13 to be pressed against the to-be-printed surface 18; and in the printing surface 13, the plurality of irregularities 14 are formed over the entire area thereof, and the elevation difference 15 from the highest part to the lowest part of the irregularities 14 falls within the range of 2 to 20 μm.

Furthermore, the printing blanket 10 according to embodiment 1 includes the elastic body which deforms to conform to the shape of the to-be-printed surface 18; the elastic body includes the printing surface 13 to be pressed against the to-be-printed surface 18; and the printing surface 13 has a surface roughness Ry of 2 to 20 μm.

Moreover, in the printing blanket 10 according to embodiment 1, the printing surface has a surface roughness Sa of 0.2 to 2.0 μM.

By virtue of such a configuration, even if the ink 17 for use in printing has high viscosity of, specifically, 100 to 1000 P, the ink 17 is reliably transferred to the printing surface of the printing blanket 10 when the printing blanket 10 is pressed against the original printing plate 16. It is therefore possible to obtain a precise printed image having a high resolution without missing ink spots.

(2) In the printing blanket 10 according to embodiment 1, the elastic body includes the base 1 and the cover layer (i.e., the sheet 2) which covers at least a part of the surface of the base 1. The printing surface 13 is a surface of the cover layer located on the opposite side of the side at which the base 1 is located.

By virtue of such a configuration, the advantage described in above item (1) can also be obtained in the elastic body having the two-layer structure. The elastic body includes the base 1 and the sheet 2, and thus even if the printing surface 13 corresponding to the surface of the sheet 2 is abraded, degraded, or soiled due to the use of the printing blanket, the sheet 2 can be replaced with a new one. Specifically, even if the elevation difference 15 of the irregularities 14 formed in the printing surface 13 is reduced by abrasion or soiling caused by repeated printing, and as a result an image is printed with missing ink spots, it suffices that the sheet 2 is replace with a new one, and it can be easily carried out. Accordingly, the base 1 of the printing blanket 10 can be used repeatedly, thus reducing the cost required for the printing blanket 10.

(3) Furthermore, in the printing blanket 10 according to embodiment 1, the elastic body contains silicon oil. With such a configuration, the ink 17 can be more easily transferred onto the to-be-printed surface 18 at the same time as the advantage mentioned in above (1) can be obtained.

(4) In the method for manufacturing the printing blanket 10 according to embodiment 1, the printing blanket 10 includes an elastic body which deforms in conformity to the shape of the to-be-printed surface 18. The elastic body includes the printing surface 13 to be pressed against the to-be-printed surface 18. The method includes an elastic-body molding step for molding the elastic body with a mold, and a printing-surface finishing step for grinding the printing surface 13 with an abrasive after the elastic-body molding step.

Furthermore, in the method for manufacturing the printing blanket 10 according to embodiment 1, the printing blanket 10 includes an elastic body which deforms in conformity to the shape of the to-be-printed surface 18, and which has the printing surface 13 to be pressed against the to-be-printed surface 18, and the elastic body includes the base 1 and the cover layer which covers at least a part of the surface of the base 1. The method includes a base molding process of molding the base 1, a cover-layer molding process of molding the cover layer, a printing-surface finishing step of grinding the printing surface 13 with an abrasive after the cover-layer molding step, and an attaching process of attaching the cover layer to the surface of the base 1.

With such a configuration, irregularities 14 having an appropriate elevation difference can be formed at the printing surface 13 of the printing blanket 10.

(5) The method for manufacturing the printing blanket 10 according to embodiment 1 includes a surface-processing process of applying a solution to the printing surface 13 prior to the printing-surface finishing step.

Alternatively, the method further includes a surface-processing process of making ozone gas blow onto the printing surface 13 prior to the printing-surface finishing step.

With such a configuration, the material of which the printing surface 13 is formed can be melted or corroded, and thus the elevation difference of the irregularities formed at the printing surface 13 can be properly processed.

(6) In a printing method using the printing blanket 10 according to embodiment 1, the printing blanket 10 includes an elastic body which deforms in conformity to the shape of the to-be-printed surface 18. The elastic body includes the printing surface 13 to be pressed against the to-be-printed surface 18. In the printing surface 13, a plurality of irregularities are formed over the entire area of the printing surface 13, and the elevation difference from the highest part to the lowest part of the irregularities falls within the range of 2 to 20 μm. The printing method includes a process of placing the ink 17 on the original printing plate 16 such that the ink 17 forms a predetermined printing pattern, a process of pressing the elastic body against the original printing plate 16 on which the ink 17 is placed, and a process of pressing the elastic body against the to-be-printed surface 18.

Furthermore, the printing method using the printing blanket 10 according to embodiment 1 may include a step for curing the ink 17 placed on the original printing plate 16 prior to the step for pressing the elastic body against the original printing plate 16. Moreover, in the printing method using the printing blanket 10 according to embodiment 1, the ink 17 to be applied may have a viscosity of 100 to 1000 P, or in a process of hardening the ink 17, the ink 17 to be applied may have a viscosity of 100 to 1000 P.

By virtue of the above configuration, the ink 17 can be prevented from being crushed and spreading, and can also be transferred to the printing surface 13 even if the ink 17 is hard, whereby an accurate print image having a high resolution can be obtained without missing ink spots.

REFERENCE SIGNS LIST

1 base 2 sheet 10 printing blanket 11 apex 13 printing surface 14 irregularities 15 elevation difference 16 original printing plate 17 ink 18 print surface

The invention claimed is:

1. A printing blanket comprising an elastic body which deforms in conformity to shape of a to-be-printed surface, wherein the elastic body includes a base, a cover layer coveting at least apart of a surface of the base, and a printing surface to be pressed against the to-be-printed surface, and wherein the printing surface is a surface of the cover layer which is located on an opposite side of a side or which the base is located, and in the printing surface, a plurality of irregularities are formed over the printing surface, wherein an elevation difference from a highest part of the irregularities to a lowest part thereof falls within a range of 2 to 20 μm, and wherein the printing surface has an arithmetical mean height Sa from 0.2 to 2.0 μm.

2. The printing blanket of claim 1, wherein the elastic bot contains silicon oil.

3. A method for manufacturing the printing blanket of claim 1, the method comprising:

molding the clastic body; and grinding the printing surface with an abrasive after molding the elastic body, wherein the plurality of irregularities has an elevation difference a highest part of irregularities to a lowest part of the irregularities that falls within a range of 2 to 20 μm, and the printing surface has an arithmetical mean height Sa of 0.2 to 2 μm.

4. The method of claim 3, further comprising applying a solution to the printing surface prior to the grinding the printing-surface.

5. The method of claim 3, further comprising:

making ozone gas blow onto the printing surface prior to the grinding the printing surface.

6. The method for manufacturing a printing blanket as in claim 3, wherein the elastic body contains silicon oil.

7. A printing method using a printing blanket, the printing blanket comprising an elastic body which deforms in conformity to a shape of a to-be-printed surface, wherein the elastic body includes a printing surface to be pressed against the to-be printed surface, and wherein in the printing surface, a plurality of irregularities are formed over the printing surface, elevation difference from a highest part of the irregularities to a lowest part thereof falls within 2 to 20 μm, and the printing surface has an arithmetical mean height Sa of 0.2 to 2.0 μm, the printing method comprising:

placing ink on an original printing plate to make the ink form a predetermined printing pattern;

pressing the elastic body against the original printing plate on which the ink is placed; and pressing the elastic body against the to-be-printed surface.

8. The printing method of claim 7, further comprising:

hardening the ink placed on the original printing plate prior to the pressing the elastic body against the original printing plate.

9. The printing, method of claim 8, wherein in the hardening the ink, the ink has a viscosity of 100 to 1000 P.

10. The printing method of claim 7, wherein the ink has a viscosity of 100 to 1000 P.

* * * * *